US011131320B2

(12) United States Patent
Ray et al.

(10) Patent No.: US 11,131,320 B2
(45) Date of Patent: Sep. 28, 2021

(54) MODULAR CUTOFF FOR A BLOWER HOUSING

(71) Applicant: Johnson Controls Technology Company, Auburn Hills, MI (US)

(72) Inventors: Elton D. Ray, Wichita, KS (US); Bennie D. Hoyt, Benton, KS (US); Paul J. Lucas, Wichita, KS (US); Jeffrey A. Leritz, Wichita, KS (US); Jordan R. Jensen, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/421,195

(22) Filed: May 23, 2019

(65) Prior Publication Data

US 2020/0318650 A1 Oct. 8, 2020

Related U.S. Application Data

(60) Provisional application No. 62/829,484, filed on Apr. 4, 2019.

(51) Int. Cl.

| | |
|---|---|
| ***F04D 29/46*** | (2006.01) |
| ***F28F 13/06*** | (2006.01) |
| ***F04D 1/00*** | (2006.01) |

(52) U.S. Cl.

CPC ..... *F04D 29/464* (2013.01); *F04D 1/00* (2013.01); *F28F 13/06* (2013.01)

(58) Field of Classification Search

CPC .. F04D 29/4226; F04D 29/424; F04D 29/462; F04D 29/464; F04D 29/46; F24F 7/065; F28F 3/06; F05D 2250/52

See application file for complete search history.

(56) References Cited

U.S. PATENT DOCUMENTS

| | | | | |
|---|---|---|---|---|
| 960,815 | A | 6/1910 | Carlisle | |
| 2,801,042 | A | 7/1957 | Thygeson | |
| 5,158,432 | A | 10/1992 | Cox | |
| 5,772,339 | A * | 6/1998 | Yamaguchi | B41J 25/308 400/55 |

(Continued)

FOREIGN PATENT DOCUMENTS

| | | | |
|---|---|---|---|
| GB | 2393220 | A | 3/2004 |
| KR | 20070034669 | A | 3/2007 |
| KR | 100845289 | B1 | 7/2008 |

*Primary Examiner* — Woody A Lee, Jr.

*Assistant Examiner* — Maxime M Adjagbe

(74) *Attorney, Agent, or Firm* — Fletcher Yoder, P.C.

(57) ABSTRACT

A centrifugal blower includes a centrifugal fan having a fan wheel that is configured to rotate about a rotational axis. The centrifugal blower includes a blower housing having a first side panel, a second side panel, and a wall extending about the rotational axis and between the first and second side panels. The centrifugal blower also includes a cutoff plate that is configured to extend about the rotational axis, where the cutoff plate includes a first end with a flange having a camber geometry and a second end that is configured to overlap with the wall such that an amount of overlap between the second end and the wall is adjustable to adjust a position of the flange relative to the fan wheel. The centrifugal blower further includes an exhaust port defined by the first side panel, the second side panel, the wall, and the flange.

25 Claims, 11 Drawing Sheets

(56) References Cited

U.S. PATENT DOCUMENTS

| | | | | |
|---|---|---|---|---|
| 5,772,399 | A | 6/1998 | Mehta et al. | |
| 7,001,149 | B1 * | 2/2006 | Waggoner | F04D 29/4226 415/204 |
| 7,529,088 | B2 * | 5/2009 | Chiu | F04D 29/161 361/695 |
| 2019/0072109 | A1 * | 3/2019 | Pirouzpanah | F04D 29/464 |
| 2019/0186499 | A1 * | 6/2019 | Pirouzpanah | F04D 29/62 |

* cited by examiner

MODULAR CUTOFF FOR A BLOWER HOUSING

CROSS-REFERENCE TO RELATED APPLICATIONS

This application claims priority from and the benefit of U.S. Provisional Application Ser. No. 62/829,484, entitled "MODULAR CUTOFF FOR A BLOWER HOUSING," filed Apr. 4, 2019, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. The HVAC system may regulate such environmental properties through control of an airflow delivered to the environment by a blower assembly or a fan. Indeed, the blower assembly may be configured to direct air across a heat exchanger of the HVAC system to facilitate exchange of thermal energy between the air and a refrigerant flowing through tubes of the heat exchanger. As such, the blower assembly may direct conditioned air discharging from the heat exchanger to rooms or spaces within a building or other suitable structure serviced by the HVAC system.

Typical blower assemblies include a rotor that is positioned within a housing of the blower assembly and is configured to rotate relative to the housing. In particular, the rotor may be configured to draw air into the housing from a surrounding environment and to force the air across a heat exchange area of the heat exchanger. In some cases, the rotor may recirculate a portion of the air that is drawn into the housing back through the housing instead of discharging the air through an outlet of the blower assembly. Accordingly, typical blower housings include a cutoff plate that is configured to decrease a quantity of air that recirculates back into the blower housing. Unfortunately, conventional cutoff plates may be inadequately positioned to effectively block air recirculation through the blower housing, thereby reducing an overall operational efficiency of the blower assembly.

SUMMARY

The present disclosure relates to a centrifugal blower that includes a centrifugal fan having a fan wheel configured to rotate about a rotational axis. The centrifugal blower includes a blower housing including a first side panel, a second side panel, and a wall extending about the rotational axis and between the first and second side panels. The centrifugal blower also includes a cutoff plate that is configured to extend about the rotational axis, where the cutoff plate includes a first end with a flange having a camber geometry and a second end that is configured to overlap with the wall such that an amount of overlap between the second end and the wall is adjustable to adjust a position of the flange relative to the fan wheel. The centrifugal blower further includes an exhaust port defined by the first side panel, the second side panel, the wall, and the flange.

The present disclosure also relates to a centrifugal blower having a blower housing that includes a first side panel, a second side panel, and a wall extending between the first and second side panels to define a chamber. The centrifugal blower includes a centrifugal fan that is positioned within the chamber and is configured to rotate about a rotational axis. The centrifugal blower also includes a cutoff plate that is coupled to the housing and extends about the rotational axis. The cutoff plate includes a first end extending into the chamber and a second end overlapping with the wall, where the first end includes a flange extending from a vertex between the cutoff plate and the flange. An amount of overlap between the second end and the wall is adjustable to adjust a position of the vertex relative to the centrifugal fan. The centrifugal blower further includes an exhaust port defined by the first side panel, the second side panel, the wall, and the vertex.

The present disclosure also relates to a centrifugal blower having a blower housing that includes a first side panel, a second side panel, and a wall extending between the first and second side panels to define a chamber. The centrifugal blower includes a centrifugal fan that is positioned within the chamber and is configured to rotate about a rotational axis. The centrifugal blower also includes a cutoff plate including a first end having a flange positioned within the chamber. The cutoff plate includes a second end having a first portion abutting an exterior surface of the wall and a second portion abutting an interior surface of the wall to slidably couple the cutoff plate to the wall. An amount of overlap between the second end and the wall is adjustable to adjust a position of the flange relative to the centrifugal fan.

DETAILED DESCRIPTION

Figure 1:
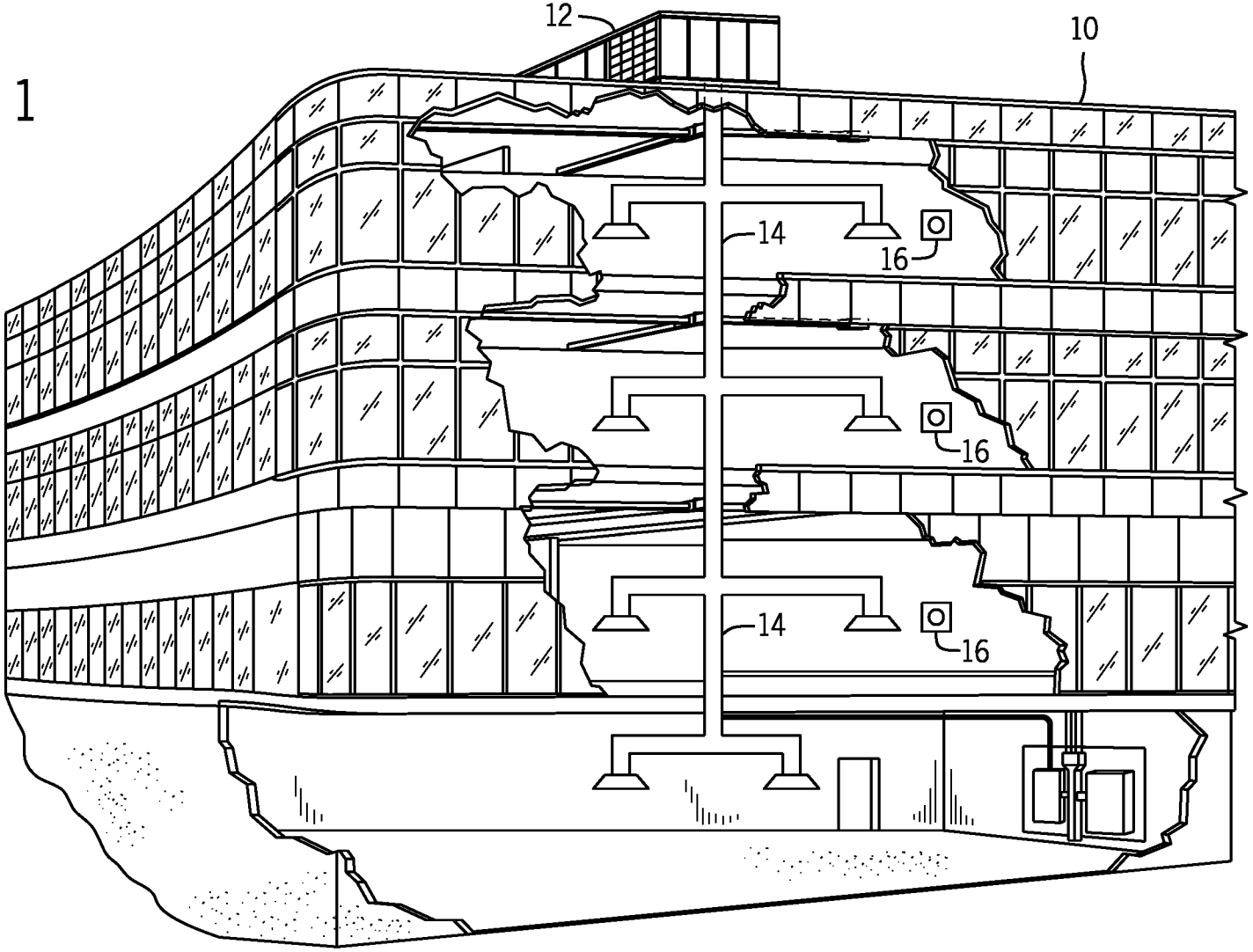
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. The HVAC system generally includes a vapor compression system that transfers thermal energy between a heat transfer fluid, such as a refrigerant, and a fluid to be conditioned, such as air. The vapor compression system typically includes a condenser and an evaporator that are fluidly coupled to one another via conduits to form a refrigerant circuit. A compressor of the refrigerant circuit may be used to circulate the refrigerant through the conduits and enable the transfer of thermal energy between the condenser and the evaporator.

The HVAC system generally includes a blower or a blower assembly that is configured to direct an air flow across the condenser and/or the evaporator to facilitate heat exchange between the air flow and the refrigerant circulating through the condenser and the evaporator. Conventional blower assemblies typically include a rotor that is positioned within a blower housing and is configured to rotate about an axis of the rotor. The blower housing may be formed from a first side panel and a second side panel that extend transverse to the rotational axis of the rotor and a wall, also referred to herein as a wrap, which extends between the first and second side panels and extends about a circumference of the rotor. Rotation of the rotor may draw an air flow into an inlet of the blower housing and may force the air flow through an outlet of the blower housing toward, for example, the evaporator or the condenser.

In many cases, the blower housing includes a cutoff plate that is integrally formed with the wall of the blower housing and is configured to reduce a quantity of air that may be recirculated into the blower housing during rotation of the rotor. As used herein, a "cutoff plate" may refer to a section of the blower housing that is positioned proximate to the outlet of the blower housing and that may define a portion of the outlet. In some cases, manufacturing inconsistencies may occur during manufacture and/or assembly of the blower assembly that may cause a position, relative to the rotor, of the wall and/or the cutoff plate to deviate from a desired target position. In particular, such manufacturing inconsistencies may cause a radial dimension between a vertex of the cutoff plate and the rotor to deviate from a target dimension, referred to herein as a "target radial dimension," that enables the cutoff plate to operate effectively. Unfortunately, typical cutoff plates may be non-adjustable or substantially limited in adjustability, such that the manufacturing inconsistencies in the blower housing may render the cutoff plates inadequate to effectively block air recirculation through the blower housing, thereby reducing an overall operational efficiency of the blower assembly.

It is now recognized that enabling adjustability of the cutoff plate relative to the wall of the blower housing may mitigate the impact of manufacturing inconsistencies in the wall and/or in other portions of the blower housing, thereby ensuring that the cutoff plate may be positioned at a desired target distance from the rotor. Specifically, by enabling the cutoff plate to be movable relative to the blower housing wall, the cutoff plate may be positionable such that a vertex of the cutoff plate is spaced apart from the rotor by the target radial dimension, irrespective of a position of the blower housing wall. Indeed, it is now recognized that positioning the vertex of the cutoff plate at the target radial dimension from the rotor may enable the cutoff plate to more effectively direct air discharging from the rotor toward the outlet of the blower housing.

Accordingly, embodiments of the present disclosure are directed toward a modular cutoff plate that is configured to translate relative to the blower housing wall to enable adjustment of the modular cutoff plate relative to the rotor of the blower assembly. In this manner, the modular cutoff plate may be used to negate manufacturing inconsistencies that may be present in the blower housing after assembly of the blower assembly. For example, the modular cutoff plate may include a flange that extends from a first end of the modular cutoff plate and one or more tabs that extend from a second end of the modular cutoff plate. As described in detail below, the tabs are configured to engage with respective slots that may be formed within the wall of the blower housing, thereby enabling the tabs to translate into or out of the slots. Accordingly, the modular cutoff plate may slide or otherwise translate relative to the blower housing wall to enable adjustment of the modular cutoff plate relative to the rotor. In particular, the modular cutoff plate may be positioned such that a radial dimension between a vertex of the flange and the rotor is substantially equal to the target radial dimension that enhances operation of the modular cutoff plate. As such, the modular cutoff plate may more effectively reduce air recirculation through the blower housing as compared to conventional cutoff plates, and thus, may increase an overall operational efficiency of the blower assembly. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
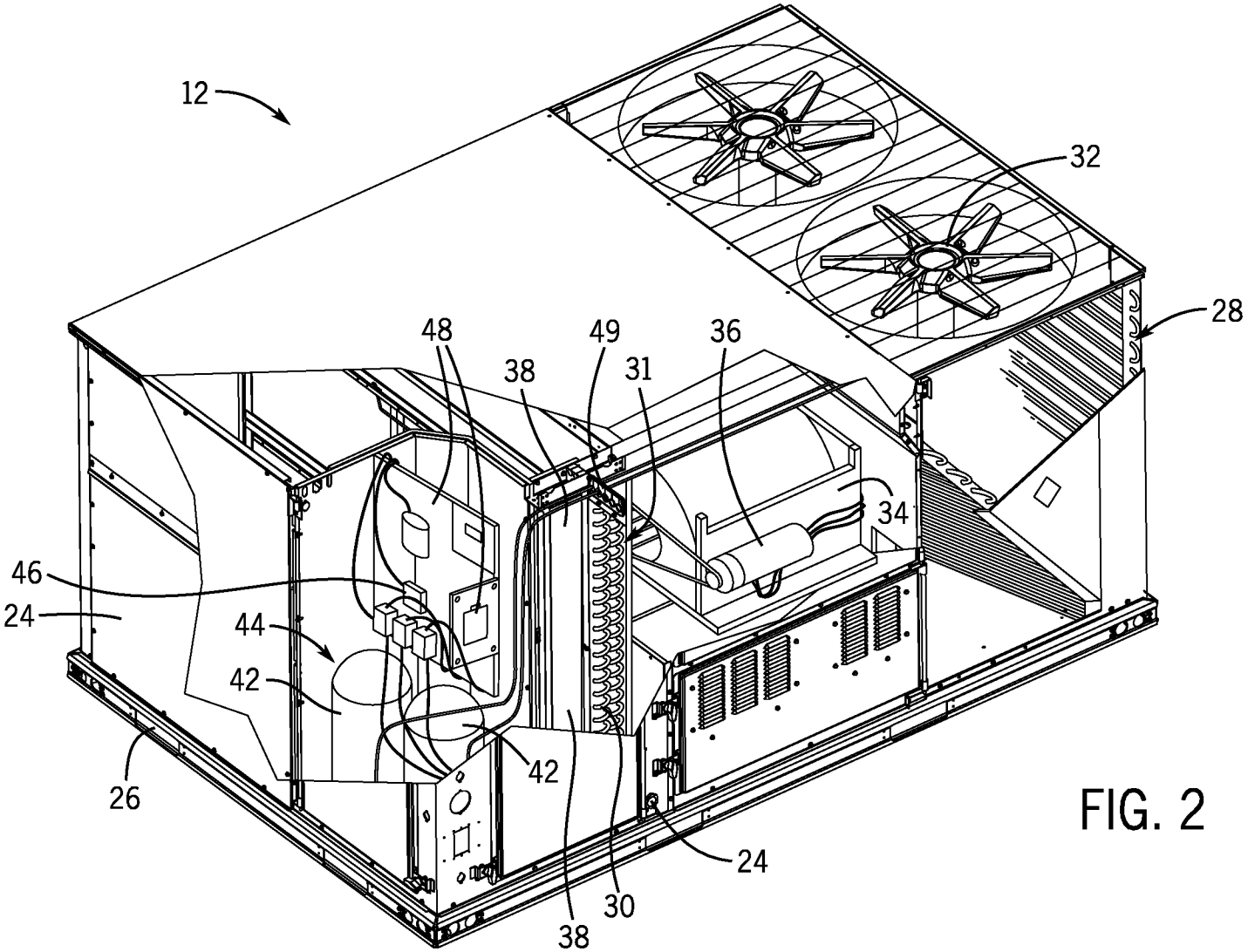
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
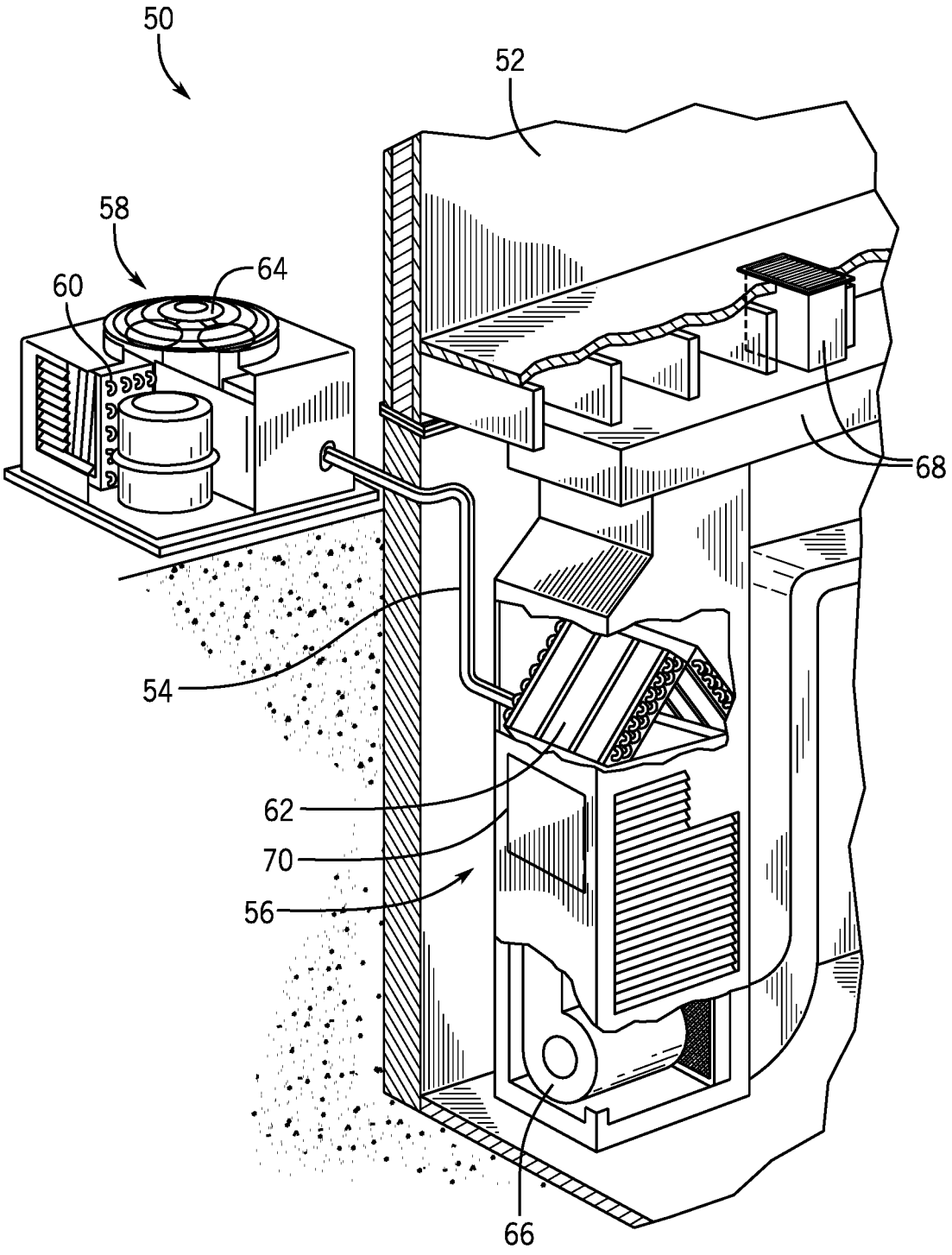
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
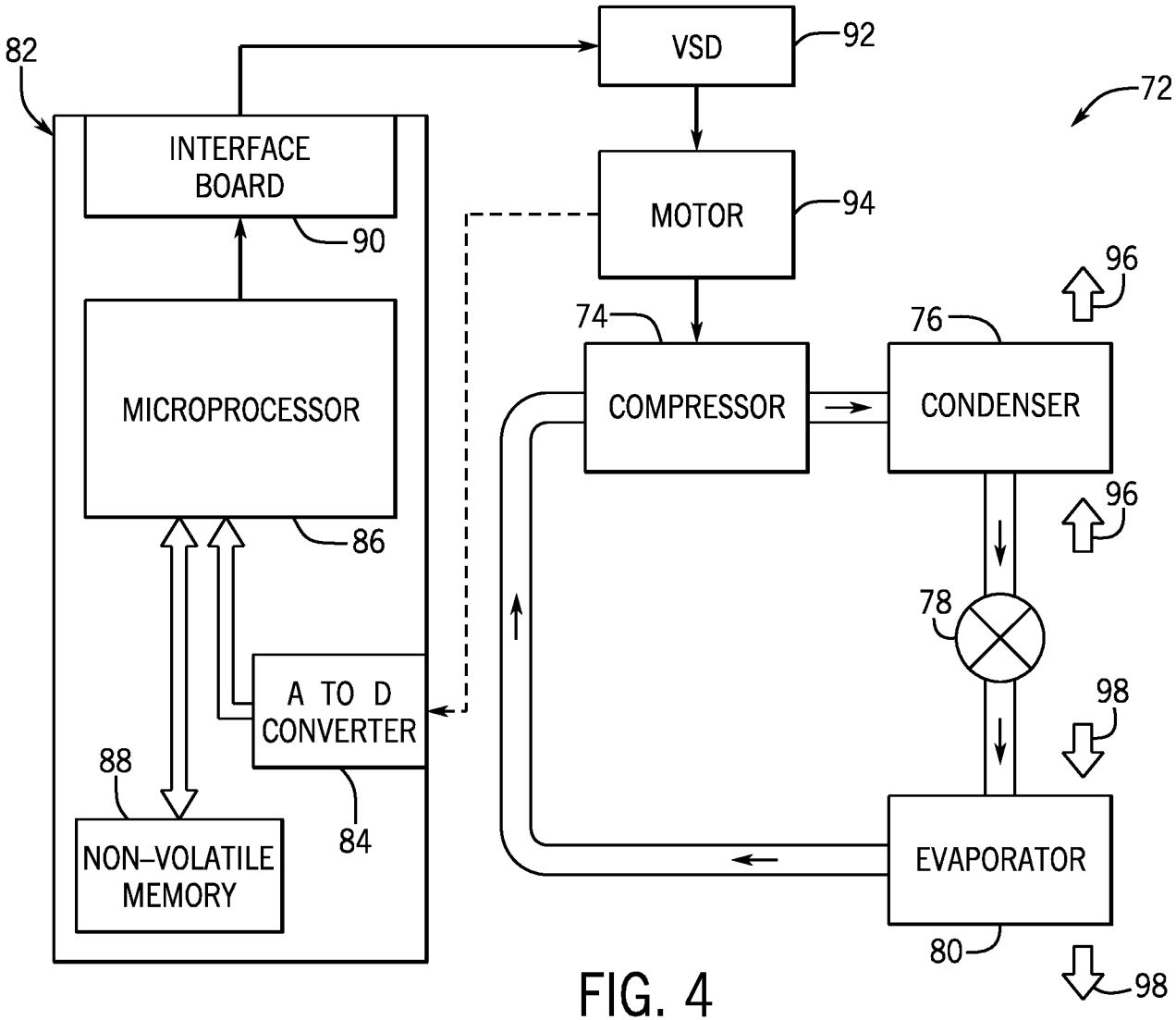
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, a blower assembly is typically used to direct an air flow across a heat exchanger or other component of an HVAC system, such as the heat exchangers 28, 30 of the HVAC unit 12 and/or the heat exchangers 60, 62 of the residential heating and cooling system 50. The blower assembly typically includes a blower housing having a cutoff plate that is configured to reduce air recirculation within the blower housing during operation of the blower assembly. As noted above, embodiments of the present disclosure are directed to improved cutoff plate, referred to herein as a modular cutoff plate, which is adjustable relative to a rotor of the blower housing, thereby enabling the modular cutoff plate to be positioned at a particular location with respect to the rotor that enhances operation of the modular cutoff plate. Specifically, the modular cutoff plate may be positioned at a location that enables the modular cutoff plate to more effectively divert air discharging from the rotor toward an outlet of the blower assembly. In this manner, the modular cutoff plate may reduce an amount of power consumed by a motor configured to drive the rotor, and thus, increase an overall operational efficiency of the blower assembly.

Figure 5:
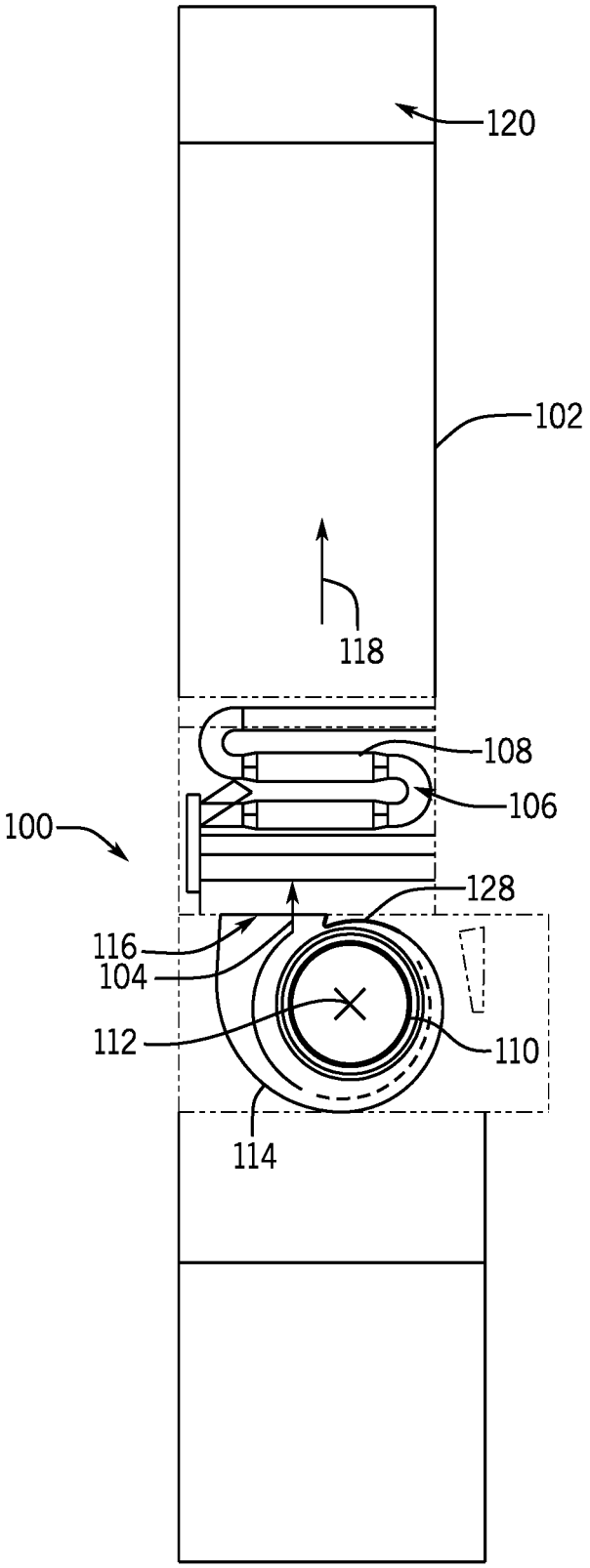
FIG. 5 is a side view of an embodiment of a blower assembly and a heat exchanger positioned within an air handling unit, in accordance with an aspect of the present disclosure.

To facilitate discussion, FIG. 5 is a side view of an embodiment of a blower assembly 100, such as the blower assembly 34, which may be included in the HVAC unit 12, the split residential heating and cooling system 50, a rooftop unit, or any other suitable HVAC system. The blower assembly 100 is positioned within an air handling unit 102 and is configured to direct an air flow 104 across a heat exchanger 106. The heat exchanger 106 conditions the air flow 104 by placing the air flow 104 in thermal communication with a working fluid, such as refrigerant or combustion products, flowing through tubes 108 of the heat exchanger 106. The blower assembly 100 includes a centrifugal fan, referred to herein as a rotor 110, which is configured to rotate about an axis 112 extending through a housing 114 of the blower assembly 100. As the rotor 110 rotates about the axis 112, blades of the rotor 110 draw air into the housing 114 and increase a velocity of the air to generate the air flow 104. The air flow 104 is subsequently directed through an outlet 116 or an exhaust port of the housing 114 and is forced across the tubes 108 of the heat exchanger 106. After exchanging thermal energy with the working fluid in the heat exchanger 106, the air flow may 104 may discharge from the heat exchanger 106 as a conditioned air flow 118. The rotor 110 may direct the conditioned air flow 118 toward an outlet 120 of the air handling unit 102, which may be fluidly coupled to the building 10. In this manner, the blower assembly 100 may facilitate supply of the conditioned air flow 118 to rooms or spaces within the building 10. As set forth above, the blower assembly 100 may include a modular cutoff plate 128 that facilitates direction of the air flow 104 toward the heat exchanger 106 and reduces an amount of air that is recirculated back into the housing 114 during operation of the blower assembly 100, thereby enhancing an efficiency of the blower assembly 100.

Figure 6:
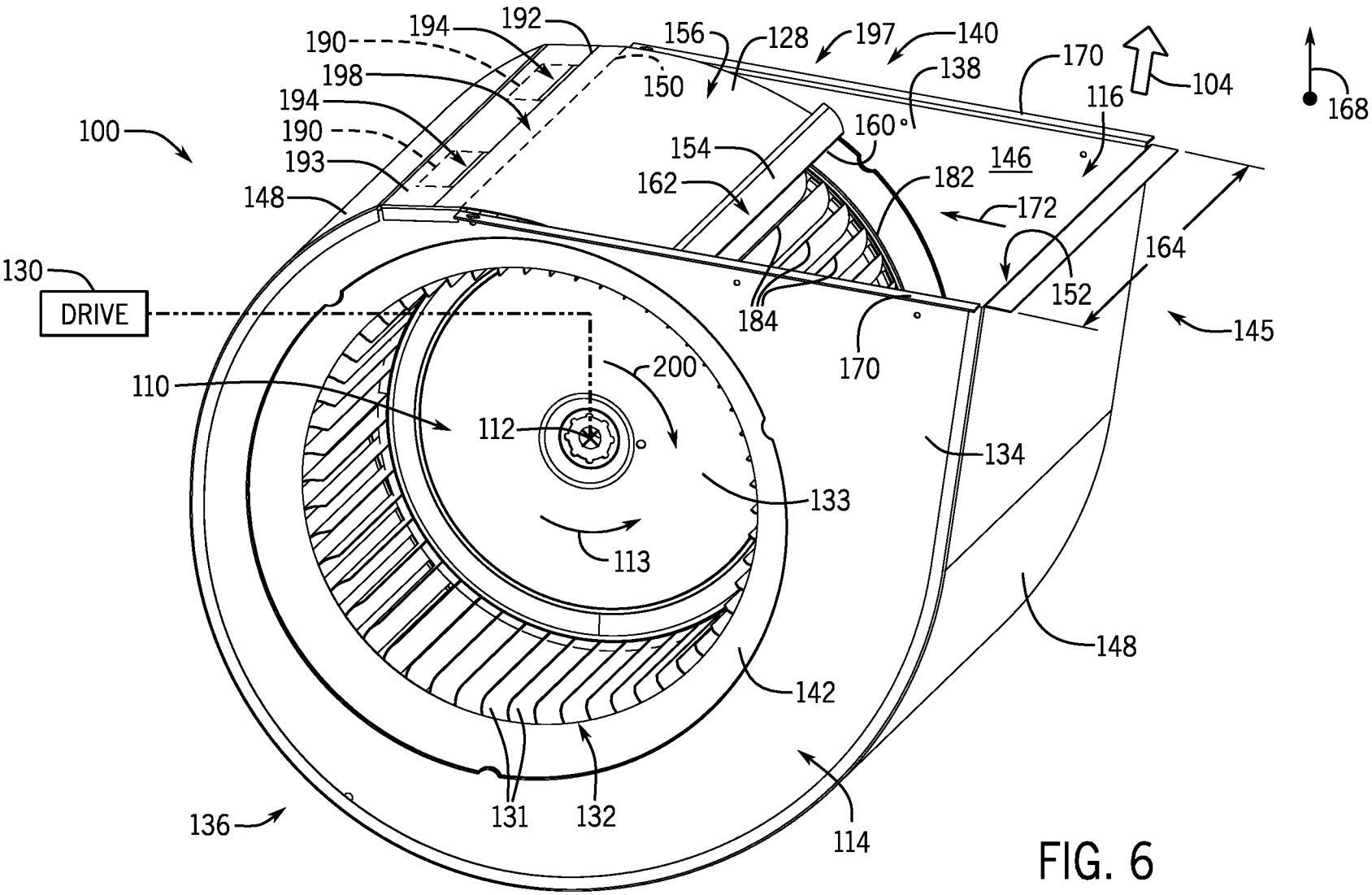
FIG. 6 is a perspective view of an embodiment of a blower assembly having a modular cutoff plate, in accordance with an aspect of the present disclosure.
Figure 10:
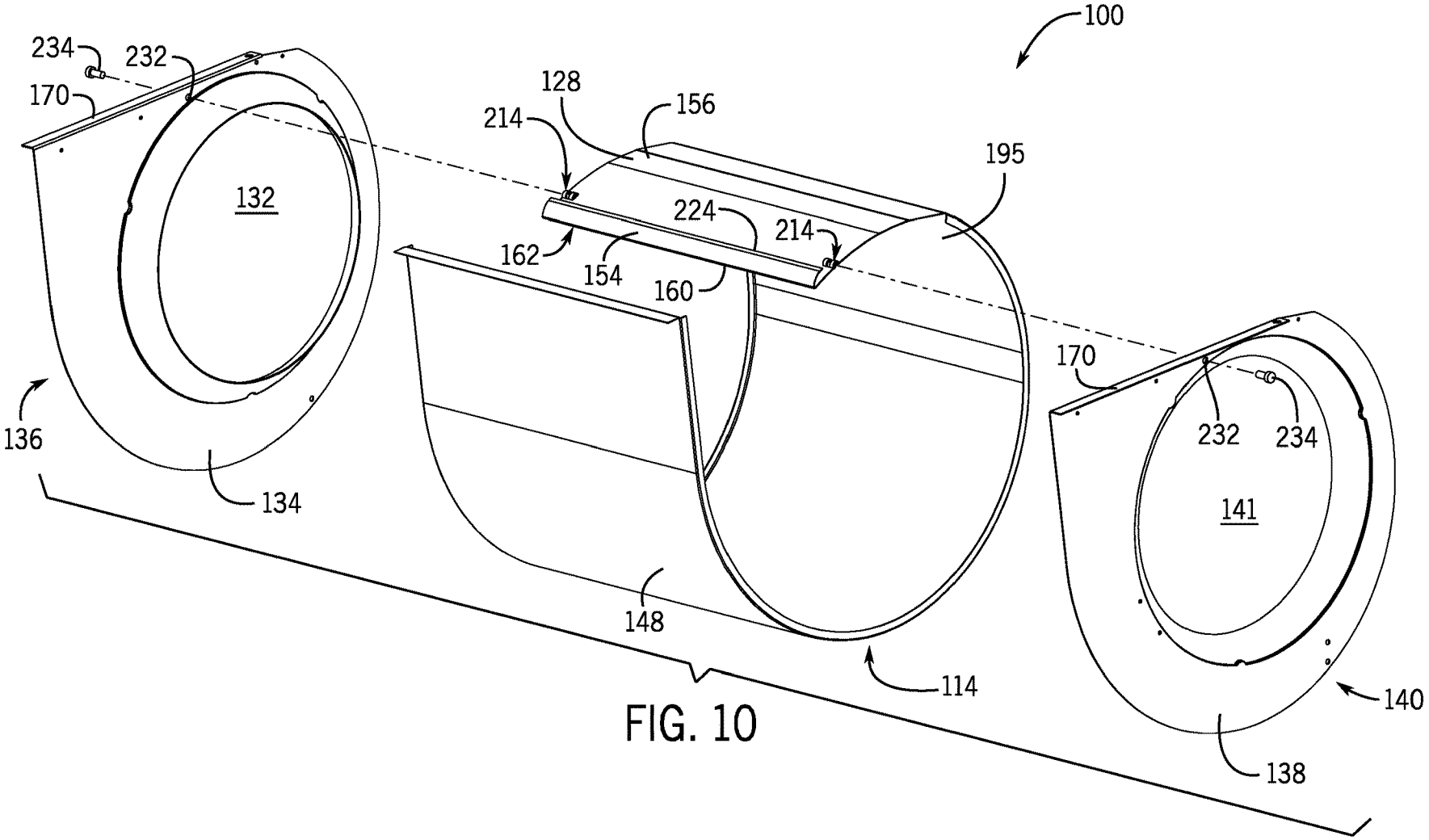
FIG. 10 is an exploded perspective view of an embodiment of a blower assembly having a modular cutoff plate, in accordance with an aspect of the present disclosure.

FIG. 6 is a perspective view of an embodiment of the blower assembly 100. As shown in the illustrated embodiment, the blower assembly 100 includes the rotor 110 that is positioned within the housing 114 and is configured to rotate about the axis 112. The blower assembly 100 may include a drive 130, such as the motor 36, which is configured to rotate the rotor 110 about the axis 112 in a counter-clockwise direction 113 relative to the housing 114. As the rotor 110 rotates about the axis 112, blades 131 extending from a fan wheel 133 of the rotor 110 may draw air into the housing 114 via an inlet 132 or intake passage that is formed within a first side panel 134 of the housing 114. The first side panel 134 is positioned on a first side 136 of the blower assembly 100 and is spaced apart from a second side panel 138 of the housing 114 that is positioned on a second side 140 of the blower assembly 100, opposite the first side 136. It should be understood that, in some embodiments, the blower assembly 100 may also include an additional inlet 141, as shown in FIG. 10, which is formed within the second side panel 138 and is in fluid communication with the rotor 110.

In some embodiments, the inlet 132 may include an annulus having a curved face 142 that may facilitate drawing air into the housing 114 via the rotor 110. For example, during operation of the blower assembly 100, air may flow through the annulus and along, or against, the curved face 142, which may direct the air into the housing 114. As noted above, rotation of the rotor 110 may cause the air drawn into the housing 114 to increase in velocity and discharge from the housing 114 via the outlet 116 or exhaust port. As such, the air flow 104 may ultimately flow toward the heat exchanger 106, such as the heat exchanger 30.

In some embodiments, the first side panel 134 and the second side panel 138 extend generally transverse to the axis 112 about which the rotor 110 rotates. In the illustrated embodiment, housing 114 includes a wall 148, also referred to herein as a wrap, which extends generally parallel to the axis 112 between the first side panel 134 and the second side panel 138. In particular, the wall 148 extends about at least a portion of a circumference of the rotor 110 and, together the first side panel 134 and the second side panel 138, forms a chamber 146 within the housing 114. Indeed, the wall 148 may commence at a first end 150 that is positioned radially inward, with respect to the axis 112, of the modular cutoff plate 128, and may extend around the rotor 110 to a second end 152 that is positioned adjacent to the outlet 116. In some embodiments, the first side panel 134, the second side panel 138, the modular cutoff plate 128, and the wall 148 may be formed from sheet metal or another suitable metallic material. In other embodiments, the first side panel 134, the second side panel 138, the modular cutoff plate 128, and the wall 148 may be formed from a polymeric material or another suitable material.

The modular cutoff plate 128 includes a flange 154 that extends from a central panel 156 of the modular cutoff plate 128 in a direction away or outwardly from the outlet 116. Accordingly, the central panel 156 and the flange 154 define a vertex 160 or a leading edge that is positioned at a first end 162 of the modular cutoff plate 128, which extends into and/or toward the chamber 146. The modular cutoff plate 128 may span between the first side panel 134 and the second side panel 138, such that the outlet 116 may be bound by a perimeter extending along the vertex 160, a portion of the first side panel 134, a portion of the second side panel 138, and a width 164 of the wall 148. Operation of the rotor 110 may force air entering the inlet 132 to flow along the wall 148 in the counter-clockwise direction 113, such that the ingested air may be discharged from the chamber 146 via the outlet 116. That is, the air may be discharged from the chamber 146 in a first direction 168, thereby forming the air flow 104. In some embodiments, the first direction 168 extends generally orthogonal to respective end flanges 170 of the first and second side panels 134, 138, which may be used to couple the blower assembly 100 to the air handling unit 102.

In some embodiments, the rotor 110 may redirect a portion of the air within the chamber 146 back into the housing 114 instead of through the outlet 116, which may reduce an efficiency of the blower assembly 100. Accordingly, the modular cutoff plate 128 includes the flange 154, which includes a particular geometry, such as a camber geometry. The geometry of the flange 154 is configured to reduce an amount of air that is redirected back into the housing 114, thereby increasing an efficiency of the blower assembly 100. Indeed, as shown in the illustrated embodiment, the flange 154 may include an air foil shape that may facilitate redirection of the air flow 104 discharging from the rotor 110 in the first direction 168 and may hinder airflow along a second direction 172 back into the housing 114.

Figure 11:
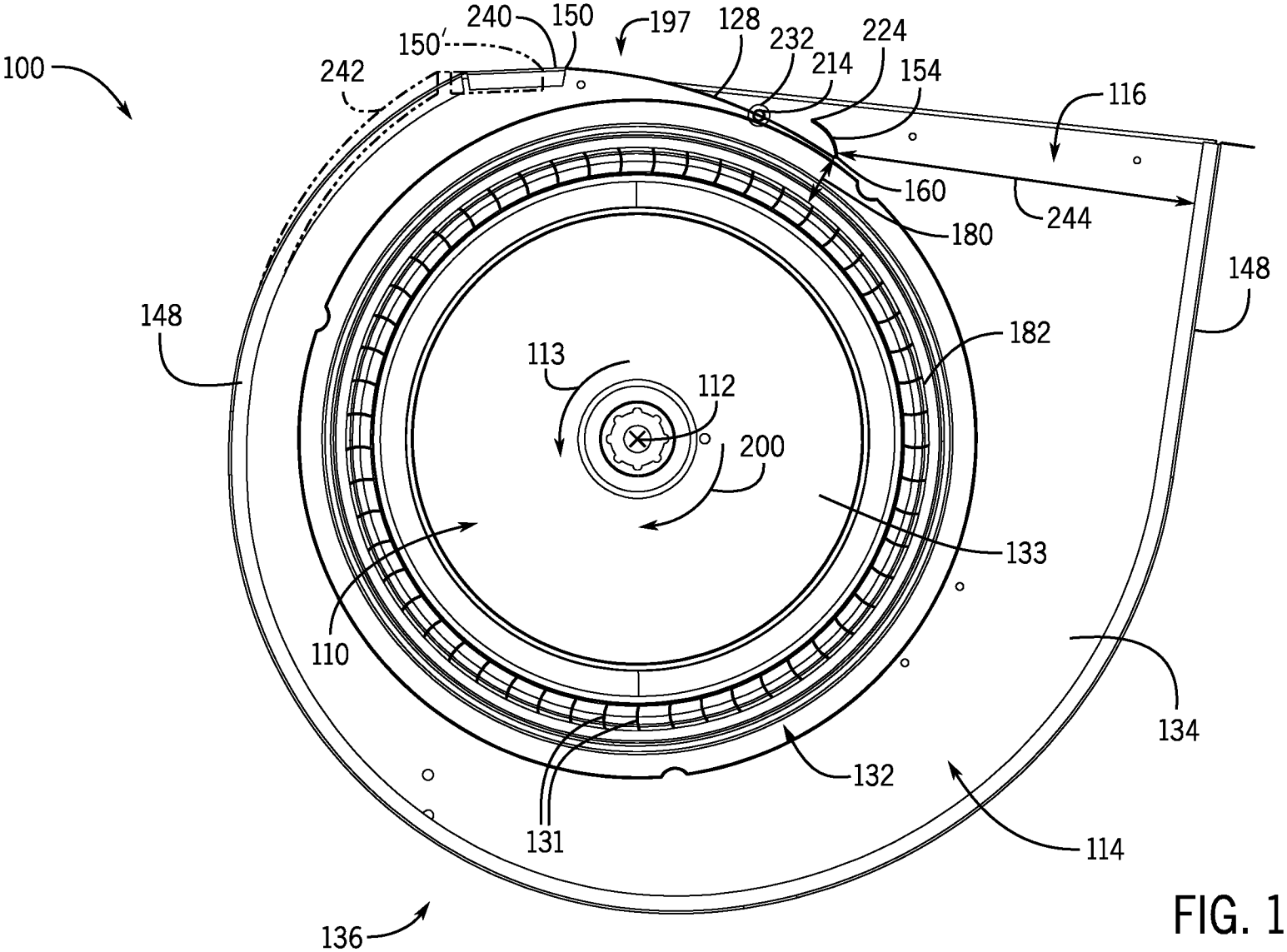
FIG. 11 is a side view of an embodiment of a blower assembly having a modular cutoff plate, in accordance with an aspect of the present disclosure.

The modular cutoff plate 128 may more effectively block air recirculation into the chamber 146 when a radial gap 180, as shown in FIG. 11, extending between the vertex 160 and an outer diameter 182 of the rotor 110 is substantially equal to a target radial dimension, such as, for example, about 0.5 inches. For clarity, as used herein, the "outer diameter 182" of the rotor 110 may refer to an outer dimension of the rotor 110 that is defined by respective radially outermost edges 184 of the blades 131. As noted above, conventional cutoff plates may be formed integrally with the wall 148 or may be rigidly coupled to the wall 148 via an adhesive or a metallurgical process, such as welding. Accordingly, when using typical cutoff plates in the blower assembly 100, alignment deviations between the wall 148 and the first and second side panels 134, 138, such as those which may occur as a result of assembly or manufacture of the blower assembly 100, may cause a dimension of the radial gap 180 to deviate from the target radial dimension. Indeed, such alignment deviations may occur, in particular, when the wall 148 is welded or otherwise affixed to the first and second side panels 134, 138 during manufacture and/or assembly of the blower assembly 100. Accordingly, the blower assembly 100 discussed herein is equipped with the modular cutoff plate 128 which, as discussed in detail below, may be a separate component of the wall 148 and/or the blower assembly 100. Particularly, the modular cutoff plate 128 is configured to translate relative to the wall 148 to enable the modular cutoff plate 128 to negate manufacturing inconsistencies that may occur during assembly of the first side panel 134, the second side panel 138, and/or the wall 148. That is, the modular cutoff plate 128 may ensure that a dimension of the radial gap 180 is substantially similar to the target radial dimension even if, for example, the wall 148 is coupled to the first and second side panels 134, 138 in misaligned manner during assembly of the blower assembly 100.

Figure 8:
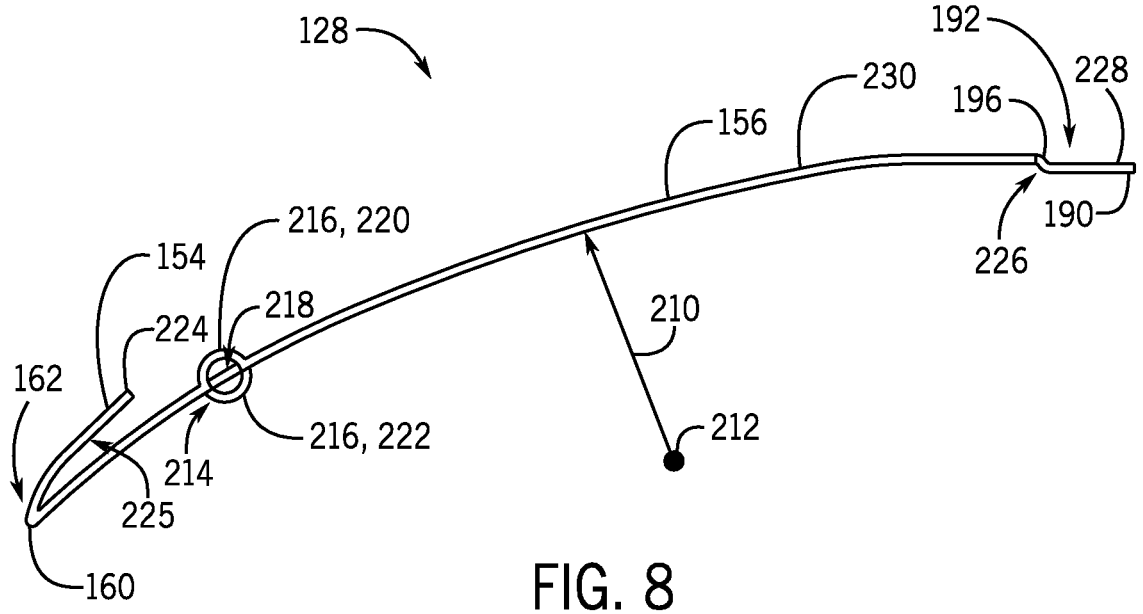
FIG. 8 is a side view of an embodiment of a modular cutoff plate for a blower assembly, in accordance with an aspect of the present disclosure.

For example, as shown in the illustrated embodiment, the modular cutoff plate 128 includes one or more tabs 190 that extend from the central panel 156 at a second end 192 of the modular cutoff plate 128 and form a portion of the second end 192. The wall 148 may include one or more slots 194 formed therein, which are positioned near the first end 150 of the wall 148. The slots 194 are configured to receive respective tabs 190 of the modular cutoff plate 128, such that engagement between the slots 194 and the tabs 190 enables the modular cutoff plate 128 to slidably couple to the wall 148. For example, the tabs 190 may include a stepped profile 196, as shown in FIG. 8, which enables the tabs 190 to extend into the slots 194 and be positioned radially inward of the wall 148, with respect to the axis 112, while the central panel 156 of the modular cutoff plate 128 is positioned radially outward of the wall 148, with respect to the axis 112. In other words, the second end 192 may include a first portion, such as a portion of the central panel 156, which may be configured to abut an exterior surface 193 of the wall 148, and a second portion, such as the tabs 190, which may be configured to extend through the slots 194 to abut an interior surface 195, as shown in FIG. 10, of the wall 148. In this manner, the modular cutoff plate 128 and the wall 148 may slidably couple to one another via a friction fit or an interference fit. Accordingly, in installed configuration 197 of the modular cutoff plate 128, the modular cutoff plate 128 may include an overlapping portion 198, which may include a portion of the central panel 156, which overlaps with the wall 148 to form a substantially air tight barrier between the modular cutoff plate 128 and the wall 148. That is, the second end 192 of the modular cutoff plate 128 may be configured to extend past the first end 150 of the wall 148 in the counter-clockwise direction 113 upon insertion of the tabs 190 into the slots 194. It should be appreciated that, in some embodiments, the central panel 156 of the modular cutoff plate 128 may be positioned radially inward of the wall 148, with respect to the axis 112, while the tabs 190 are configured to extend into the slots 194 and be positioned radially outward of the wall 148, with respect to the axis 112.

In any case, the engagement between the slots 194 and tabs 190 enables the modular cutoff plate 128 to translate relative to the wall 148 and the first and second side panels 134, 138 in a clockwise direction 200 about the axis 112 or in the counter-clockwise direction 113 about the axis 112, thereby enabling adjustment of a positon of the modular cutoff plate 128 relative to the wall 148 and the first and second side panels 134, 138. That is, the engagement between the slots 194 and tabs 190 may enable the modular cutoff plate 128 to slide or otherwise translate relative to the wall 148 and the first and second side panels 134, 138 to adjust an amount of overlap between the second end 192 of the modular cutoff plate 128 and the first end 150 of the wall 148. In some embodiments, translational movement of the modular cutoff plate 128 relative to the wall 148 in the counter-clockwise direction 113 may increase a dimension of the radial gap 180 between the vertex 160 and the outer diameter 182 of the rotor 110. Conversely, translational movement of the modular cutoff plate 128 relative to the wall 148 in the clockwise direction 200 may decrease the dimension of the radial gap 180 between the vertex 160 and the outer diameter 182 of the rotor 110. Accordingly, adjustments in the amount of overlap between the second end 192 of the modular cutoff plate 128 and the wall 148 may adjust the dimension of the radial gap 180.

The adjustability of the modular cutoff plate 128 may ensure that the vertex 160 may be positioned at the target radial dimension from the rotor 110 when the modular cutoff plate 128 is in the installed configuration 197, even when manufacturing inconsistencies cause positional variations of the wall 148 relative to the first and second side panels 134, 138. Indeed, as discussed below, the modular cutoff plate 128 may be configured to couple to the first and second side panels 134, 138 in a position, such as the installed configuration 197, in which a dimension of the radial gap 180 is substantially equal to, such as within five percent of, the target radial dimension of the radial gap 180.

Figure 7:
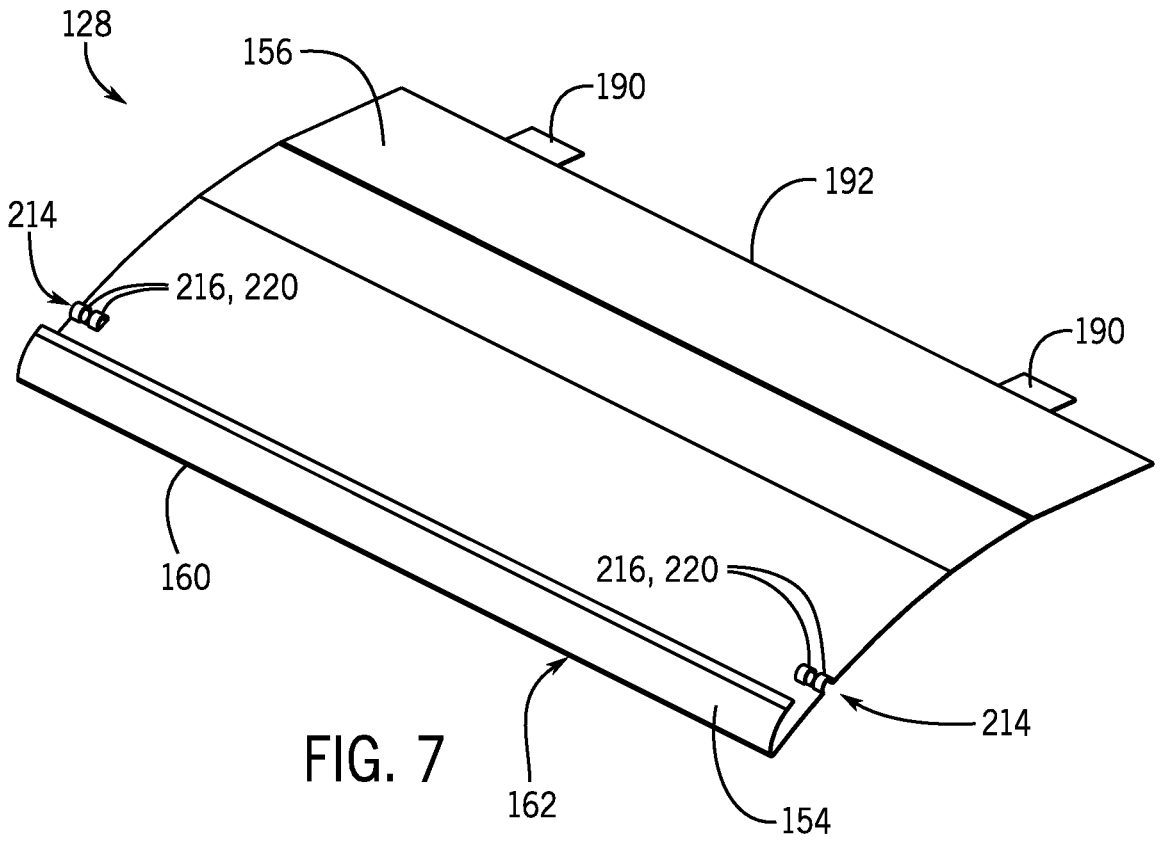
FIG. 7 is a perspective view of an embodiment of a modular cutoff plate for a blower assembly, in accordance with an aspect of the present disclosure.

FIG. 7 is a perspective view of an embodiment of the modular cutoff plate 128, and FIG. 8 is a side view of an embodiment of the modular cutoff plate 128. FIGS. 7 and 8 are discussed concurrently below. In some embodiments, the modular cutoff plate 128 may be a single piece component, such as a single piece of sheet metal, which may be formed, cut, punched, and/or bent into a desired shape of the modular cutoff plate 128. For example, the modular cutoff plate 128 may be bent, cut, punched, and/or deformed to include the flange 154, the tabs 190, and a radius of curvature 210, as shown in FIG. 8, which extends from a centroid 212. In some embodiments, the modular cutoff plate 128 may be bent, such that the radius of curvature 210 is substantially equal to a radius of curvature of the rotor 110. In other embodiments, the radius of curvature 210 may be greater than or less than a radius of curvature of the rotor 110.

As shown in the illustrated embodiment, the modular cutoff plate 128 includes a pair of retainers 214 that, as discussed in detail below, enable suitable fasteners to couple the modular cutoff plate 128 to the first and second side panels 134, 138 of the housing 114. In some embodiments, the retainers 214 may be integrally formed within the central panel 156. For example, the retainers 214 may each include a plurality of lances 216 that are extruded or bent from the central panel 156 to define respective fastener receptacles 218 of the retainers 214, which are configured to receive fasteners, such as screws, friction pins, or bolts. In particular, the lances 216 may include a first set of lances 220 that extend radially outward from the central panel 156, with respect to the centroid 212, and a second set of lances 222 that extend radially inward from the central panel 156, with respect to the centroid 212. Accordingly, the first set of lances 220 and the second set of lances 222 may cooperatively define the fastener receptacles 218, which extend between respective lances 216 of the first and second sets of lances 220, 222. Although two retainers 214 are shown in the illustrated embodiment, it should be understood that in other embodiments, the modular cutoff plate 128 may include any suitable quantity of retainers 214, such as, for example, 1, 2, 3, 4, or more than four retainers 214.

In the illustrated embodiment, the flange 154 includes a leading edge, such as the vertex 160, and a trailing edge 224, which is distal to the central panel 156. The flange 154 may radially diverge, with respect to the centroid 212, from the vertex 160 and toward the trailing edge 224 to define the cross-sectional camber geometry of the flange 154. In some embodiments, a radially inner surface 225 of the flange 154 may include a generally concave profile. However, in other embodiments, the radially inner surface 225 may include any other suitable profile or shape.

As briefly discussed above, the tabs 190 of the modular cutoff plate 128 include the stepped profile 196, which may facilitate insertion of the tabs 190 into the slots 194 of the wall 148. Indeed, the tabs 190 may include a bend 226, such as an "S"-shaped bend, that enables an outer surface 228 of the tabs 190 to be positioned radially inward, with respect to the centroid 212, of an outer surface 230 of the central panel 156. Indeed, in some embodiments, a differential between a radial dimension of the outer surface 230 of the central panel 156 and a radial dimension of the outer surface 228 of the tabs 190, relative to the centroid 212, may be approximately equal to a radial thickness of the wall 148. As such, the tabs 190 may translate into or out of the slots 194 without binding against the wall 148.

It should be appreciated that, in other embodiments, the modular cutoff plate 128 may be formed from multiple components that are coupled together to collectively form the modular cutoff plate 128. That is, the flange 154, the tabs 190, the retainers 214, or any combination thereof, may be coupled to the central panel 156 via fasteners, suitable adhesives, or a metallurgical process, such as welding. As a non-limiting example, in some embodiments, the retainers 214 may include, for example, a pair of threaded nuts that are coupled to the central panel 156 via a welding process.

Figure 9:
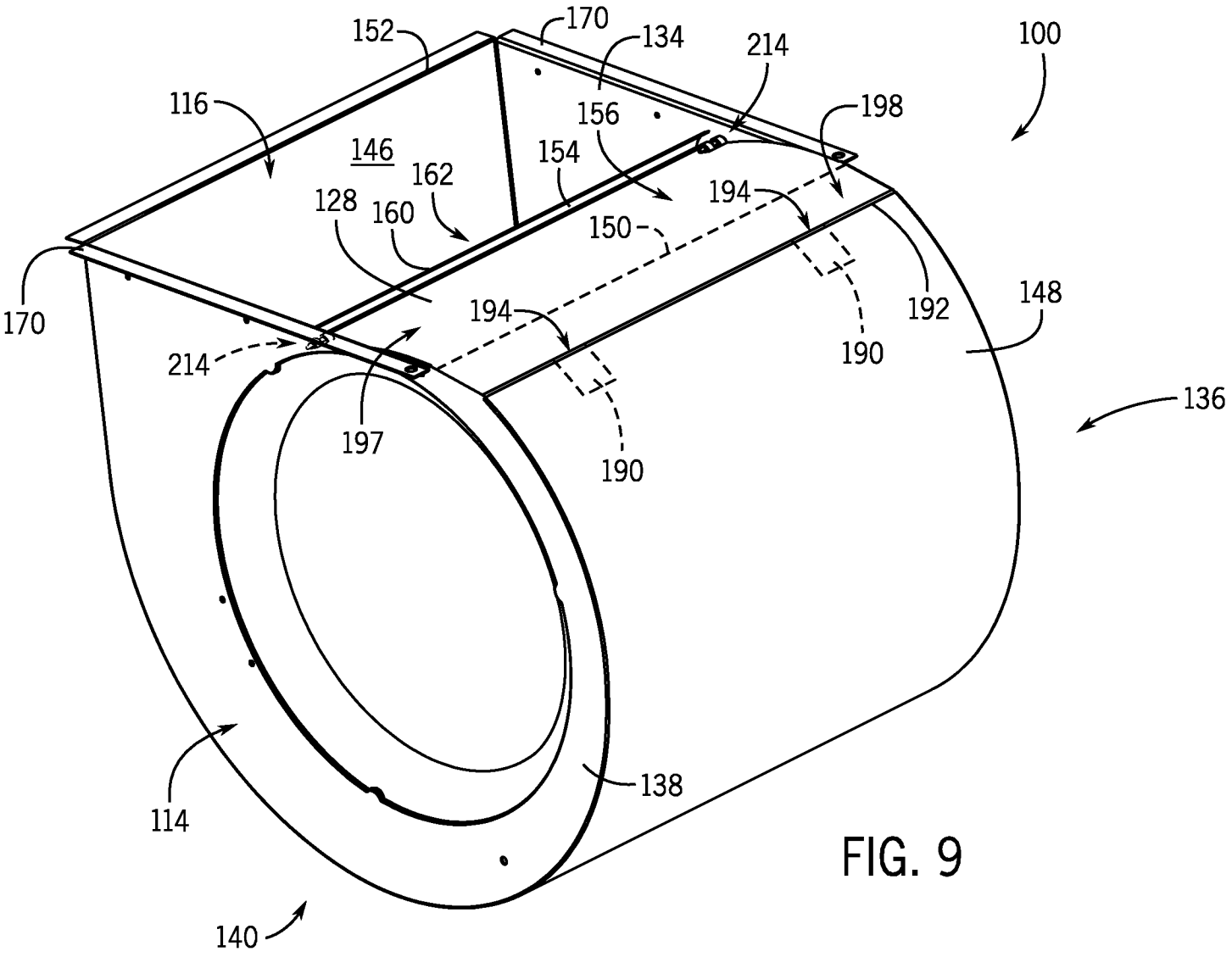
FIG. 9 is a perspective view of an embodiment of a blower assembly having a modular cutoff plate, in accordance with an aspect of the present disclosure.

FIG. 9 is a perspective view of an embodiment of the blower assembly 100. FIG. 10 is an exploded perspective view of an embodiment of the blower assembly 100. FIGS. 9 and 10 are discussed concurrently below. In the installed configuration 197 of the modular cutoff plate 128, the retainers 214 are aligned with respective apertures 232 that are formed within the first side panel 134 and the second side panel 138 of the housing 114. Accordingly, fasteners 234 may extend through the respective apertures 232 and engage with one of the retainers 214 to couple the modular cutoff plate 128 to the first side panel 134 and the second side panel 138 and to affix a position of the modular cutoff plate 128 relative to the rotor 110. A location of the apertures 232 within the first and second side panels 134, 138 may therefore define a position of the vertex 160 relative to the rotor 110. Accordingly, the apertures 232 may be formed within the first and second side panels 134, 138 at particular locations that enable spacing of the vertex 160 from the rotor 110 by the target radial dimension when the modular cutoff plate 128 is coupled to the first and second side panels 134, 138 via the fasteners 234.

As noted above, the engagement between tabs 190 and the slots 194 enables the modular cutoff plate 128 to slide or translate relative to the wall 148 to increase or decrease a dimension of the overlapping portion 198 and to also increase or decrease a dimension of the spacing between the vertex 160 and the rotor 110. This translational adjustability of the modular cutoff plate 128 may enable the retainers 214 to be aligned with the apertures 232 even if the wall 148 is offset or misaligned from a target positon relative to the first side panel 134 and/or the second side panel 138. For example, and to better illustrate, FIG. 11 is a side view of an embodiment of the blower assembly 100 having the modular cutoff plate 128 in the installed configuration 197. The slidable engagement between the tabs 190 and slots 194 enables positional adjustment of the modular cutoff plate 128, such that the retainers 214 may align with the apertures 232 when the wall 148 is coupled to the first and second side panels 134, 138 in an aligned position 240 or in the target position, as well as when the wall 148 is coupled to the first and second side panels 134, 138 in a misaligned position 242 that may be caused by manufacturing inconsistencies of the blower assembly 100. Accordingly, the modular cutoff plate 128 may be positioned in the installed configuration 197, in which a dimension of the radial gap 180 is substantially equal to the target radial dimension, irrespectively of whether the wall 148 is coupled to the first and second side panels 134, 138 in the aligned position 240 or in the misaligned position 242.

Indeed, the modular cutoff plate 128 may enable the vertex 160 to be positioned at the target radial dimension from the rotor 110, as well as enable the vertex 160 to be positioned at a target circumferential position with respect to the rotor 110, regardless of whether the first end 150 is at a location, with respect to the first and second side panels 134, 138, corresponding to the aligned position 240 of the wall 148, or whether the first end 150' is at a location, with respect to the first and second side panels 134, 138, corresponding to the misaligned position 242 of the wall 148. It should be appreciated that a dimension of the overlapping portion 198 may be sized to enable the modular cutoff plate 128 to overlap with the wall 148 in the installed configuration 197 both when the wall 148 is in the aligned position 240 and when the wall 148 in the misaligned position 242. In this way, in the installed configuration 197 of the modular cutoff plate 128, the overlapping portion 198 may form a substantially air tight barrier between the modular cutoff plate 128 and the wall 148.

It should be understood that, in certain embodiments, the first side panel 134 and the second side panel 138 may each include one or more additional apertures formed therein that enable the modular cutoff plate 128 to be affixed to the first and second side panels 134, 138 at various positions relative to the rotor 110. For example, such apertures may enable the vertex 160 to be positioned at various radial locations and/or circumferential locations with respect to the rotor 110 when the modular cutoff plate 128 is in the installed configuration 197. Accordingly, the one or more additional apertures may enable adjustments in a dimension of the radial gap 180 and/or a width 244 of the outlet 116. Additionally or alternatively, the apertures 232 may include an elongated profile, thereby enabling the fasteners 234 to be positioned along a particular portion of the elongated apertures 232 before being tightened to affix the modular cutoff plate 128 to the first and second side panels 134, 138. As such, the elongated apertures 232 may also enable the dimension of the radial gap 180 and/or the width 244 of the outlet 116 to be adjustable.

Figure 12:
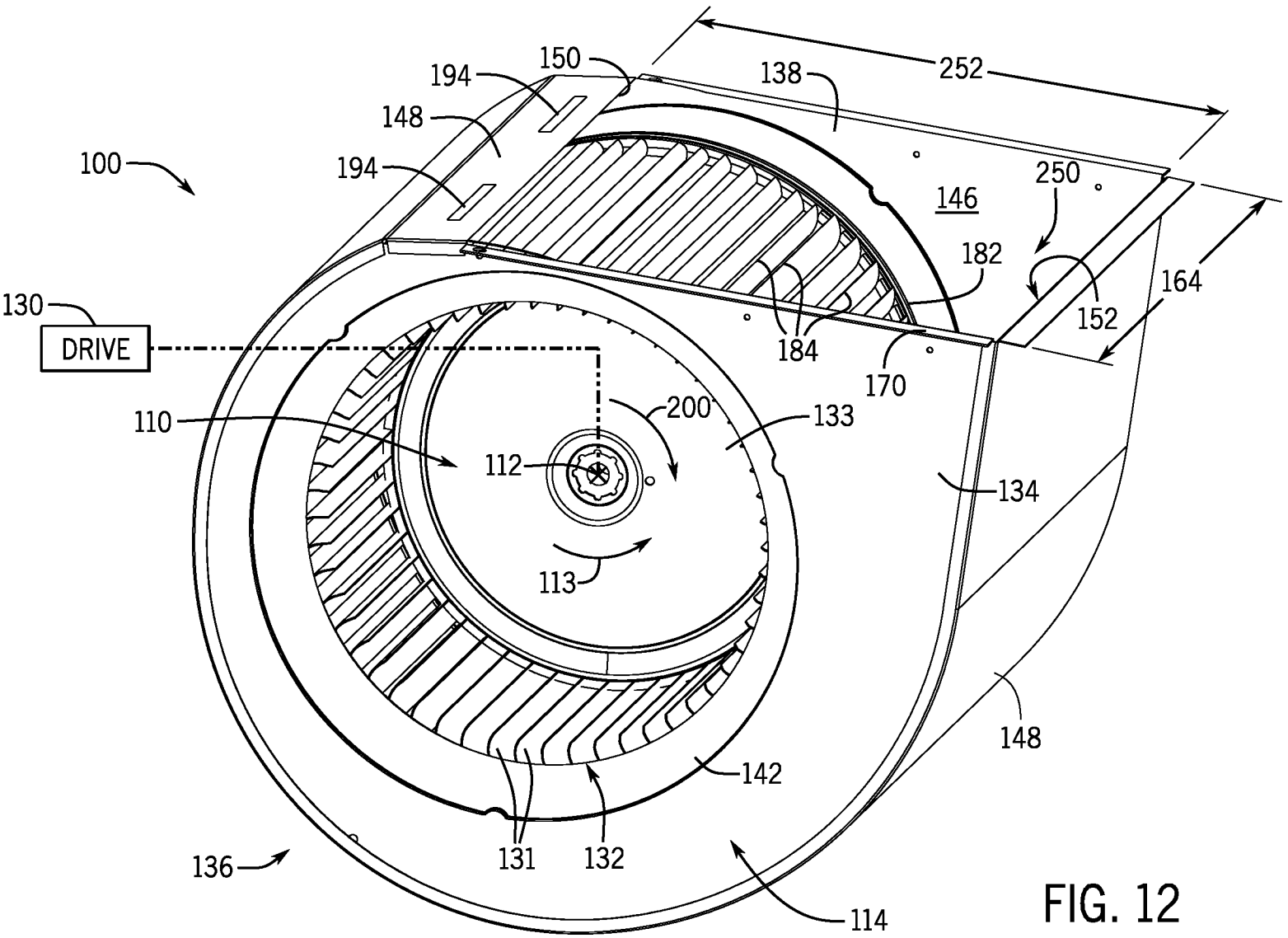
FIG. 12 is a perspective view of an embodiment of a blower assembly with a modular cutoff plate removed from a blower housing of the blower assembly to expose an opening of the blower housing, in accordance with an aspect of the present disclosure.

In certain embodiments, the modular cutoff plate 128 may be detachable from the housing 114 to enable extraction of the rotor 110 from the housing 114. To better illustrate, FIG. 12 is a perspective view of an embodiment of the blower assembly 100 in which the modular cutoff plate 128 is removed from the housing 114 to define an opening 250 that extends between the first side panel 134, the second side panel 138, and the first and second ends 150, 152 of the wall 148. The opening 250 may include a length 252 that is greater than the outer diameter 182 of the rotor 110. Accordingly, upon decoupling the rotor 110 from the drive 130, the rotor 110 may be extracted from the chamber 146 via the opening 250. As such, removal of the modular cutoff plate 128 may facilitate access to the rotor 110, the drive 130, and/or other components of the blower assembly 100 that may be positioned within the housing 114 for maintenance, inspection, or other purposes.

As set forth above, embodiments of the present disclosure may provide one or more technical effects useful for positioning the modular cutoff plate 128 at a location of the housing 114 that enhances an operational effectiveness of the modular cutoff plate 128. More specifically, the disclosed modular cutoff plate 128 is translatable relative to the wall 148 to reduce the impact of manufacturing inconsistencies in the wall 148 and/or other portions of the housing 114. Specifically, the adjustability of the modular cutoff plate 128 enables the vertex 160 to be spaced apart from the rotor 110 by a target radial dimension to cause the modular cutoff plate 128 to more effectively direct air discharging from the rotor 110 toward the outlet 116 of the housing 114. In this manner, the modular cutoff plate 128 may more effectively reduce or mitigate air recirculation through the housing 114, as compared to conventional cutoff plates. As such, the modular cutoff plate 128 may decrease an amount of power consumed by drive 130, and thus, increase an overall operational efficiency of the blower assembly 100. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A centrifugal blower, comprising:

a centrifugal fan including a fan wheel, wherein the fan wheel has a rotational axis;

a blower housing including a first side panel, a second side panel, and a wall extending about the rotational axis and between the first and second side panels;

a cutoff plate extending from the first side panel to the second side panel and configured to extend about the rotational axis, wherein the cutoff plate includes a first end with a flange having a camber geometry and a second end configured to overlap with the wall, wherein the cutoff plate is configured to translate along and relative to the wall such that an amount of overlap between the second end and the wall is adjustable to adjust a position of the flange relative to the fan wheel, and wherein at least a portion of the cutoff plate overlapping with the wall is positioned radially outside of the wall with respect to the rotational axis; and an exhaust port defined by the first side panel, the second side panel, the wall, and the flange.

2. The centrifugal blower of claim 1, wherein the wall includes a slot, the second end includes a tab extending from an edge of the second end and configured to be positioned within the slot, and a position of the tab within the slot is adjustable to adjust the amount of overlap.

3. The centrifugal blower of claim 1, wherein the camber geometry includes a leading edge coupled to the cutoff plate, and the amount of overlap between the second end and the wall is adjustable to adjust a radial gap, relative to the rotational axis, between the fan wheel and the leading edge.

4. The centrifugal blower of claim 3, wherein the camber geometry includes a trailing edge distal to the cutoff plate.

5. The centrifugal blower of claim 1, wherein the cutoff plate is configured to be secured to the first side panel and the second side panel to affix the position of the flange relative to the fan wheel.

6. The centrifugal blower of claim 5, wherein the cutoff plate includes a first retainer and a second retainer, and wherein the centrifugal blower includes a first fastener configured to extend through the first side panel and engage with the first retainer and a second fastener configured to extend through the second side panel and engage with the second retainer.

7. The centrifugal blower of claim 6, wherein the first retainer and the second retainer each comprise a plurality of lances formed in the cutoff plate.

8. The centrifugal blower of claim 1, wherein the centrifugal fan includes a plurality of blades extending radially outwardly from the fan wheel, wherein respective edges of the plurality of blades distal to the fan wheel cooperatively define an outer diameter of the centrifugal fan, wherein the flange extends from a central panel of the cutoff plate along a vertex between the flange and the central panel, and wherein the amount of overlap between the second end and the wall is adjustable to adjust a radial gap between the outer diameter and the vertex.

9. The centrifugal blower of claim 1, wherein the flange extends outwardly relative to the exhaust port.

10. The centrifugal blower of claim 1, wherein a radially inner surface of the flange, relative to the rotational axis, is a concave surface.

11. A centrifugal blower, comprising:

a blower housing including a first side panel, a second side panel, and a wall extending between the first and second side panels to define a chamber, wherein the wall includes a slot formed therein;

a centrifugal fan positioned within the chamber and configured to rotate about a rotational axis;

a cutoff plate coupled to the blower housing and extending from the first side panel to the second side panel, wherein the cutoff plate extends about the rotational axis and includes a first end extending into the chamber and a second end overlapping with the wall, wherein the first end includes a flange extending from a central panel of the cutoff plate along a vertex between the central panel and the flange, wherein the second end includes a tab extending from an edge of the central panel and into the slot, and wherein the tab is configured to translate along and relative to the slot such that an amount of overlap between the second end and the wall is adjustable to adjust a position of the vertex relative to the centrifugal fan; and an exhaust port defined by the first side panel, the second side panel, the wall, and the vertex.

12. The centrifugal blower of claim 11 wherein the tab and at least a portion of the central panel overlap with the wall, wherein the tab is positioned radially inward of the wall, with respect to the rotational axis, and the central panel is positioned radially outside of the wall, with respect to the rotational axis, in an installed configuration of the cutoff plate.

13. The centrifugal blower of claim 11, wherein the cutoff plate extends from the wall toward the centrifugal fan to define a radial gap, relative to the rotational axis, between the vertex and the centrifugal fan, wherein the amount of overlap between the second end and the wall is adjustable to adjust the radial gap.

14. The centrifugal blower of claim 11, wherein the cutoff plate includes a first retainer and a second retainer, wherein the centrifugal blower includes a first fastener extending through the first side panel to engage with the first retainer and a second fastener extending through the second side panel to engage with the second retainer to secure the cutoff plate to the first side panel and the second side panel.

15. The centrifugal blower of claim 14, wherein the first retainer and the second retainer are integrally formed with the cutoff plate.

16. The centrifugal blower of claim 11, wherein the cutoff plate is detachable from the blower housing to expose an opening extending between the first side panel, the second side panel, and opposing ends of the wall, wherein the centrifugal fan is removable from the chamber via the opening.

17. The centrifugal blower of claim 11, wherein the slot includes an aperture formed within the wall.

18. The centrifugal blower of claim 11, wherein at least a portion of the cutoff plate overlapping with the wall is positioned radially exterior to the wall with respect to the rotational axis.

19. A centrifugal blower, comprising:

a blower housing including a first side panel, a second side panel, and a wall extending between the first and second side panels to define a chamber;

a centrifugal fan positioned within the chamber and configured to rotate about a rotational axis; and a cutoff plate extending from the first side panel to the second side panel, wherein the cutoff plate includes a first end having a flange positioned within the chamber, wherein the cutoff plate includes a second end overlapping with the wall and having a first portion abutting a radially exterior surface of the wall and a second portion abutting a radially interior surface of the wall to slidably couple the cutoff plate to the wall, and wherein the cutoff plate is configured to translate along and relative to the wall such that an amount of overlap between the second end and the wall is adjustable to adjust a position of the flange relative to the centrifugal fan.

20. The centrifugal blower of claim 19, wherein the wall includes a slot, the second portion includes a tab extending from an edge of a central panel of the cutoff plate and positioned within the slot, and a position of the tab relative to the slot is adjustable to adjust the amount of overlap.

21. The centrifugal blower of claim 19, wherein the cutoff plate includes a first retainer and a second retainer, wherein the centrifugal blower includes a first fastener configured to extend through the first side panel and engage with the first retainer and a second fastener configured to extend through the second side panel and engage with the second retainer to affix the cutoff plate to the blower housing.

22. The centrifugal blower of claim 21, wherein the first retainer and the second retainer are formed integrally with the cutoff plate, and the cutoff plate is formed from a metallic material.

23. The centrifugal fan of claim 19, wherein the cutoff plate is a single piece component.

24. The centrifugal fan of claim 19, wherein the cutoff plate is detachable from the blower housing to expose an opening extending between the first side panel, the second side panel, and opposing ends of the wall, wherein the centrifugal fan is removable from the chamber via the opening.

25. The centrifugal fan of claim 19, wherein the blower housing includes:

an intake passage extending through the first side panel; and an exhaust port defined by the first side panel, the second side panel, the wall, and a vertex of the cutoff plate, wherein the vertex extends between a central panel of the cutoff plate and the flange, wherein the centrifugal fan is configured to draw a fluid flow into the chamber via the intake passage and to discharge the fluid flow from the chamber via the exhaust port.

* * * * *